United States Patent [19]

Lappa

[11] 4,256,061

[45] Mar. 17, 1981

[54] TWO CYCLE ROTARY INTERNAL COMBUSTION ENGINE AND CYLINDER SEALING RING ARRANGEMENT THEREFOR

[76] Inventor: Cleto L. Lappa, 541 Torwood Ln., Pittsburgh, Pa. 15236

[21] Appl. No.: 958,637

[22] Filed: Nov. 8, 1978

Related U.S. Application Data

[63] Continuation-in-part of Ser. No. 838,383, Sep. 30, 1977, Pat. No. 4,136,646.

[51] Int. Cl.[3] ..... F02B 57/08

[52] U.S. Cl. ..... 123/44 D; 277/3; 277/25

[58] Field of Search ..... 123/44 D, 43 A, 43 AA; 418/115, 117; 277/3, 25, 81 P; 91/491

[56] References Cited

U.S. PATENT DOCUMENTS

| | | | |
|---|---|---|---|
| 1,042,675 | 10/1912 | Helmes | 123/44 D X |
| 1,184,651 | 5/1916 | Johnston | 123/44 D |
| 1,569,525 | 1/1926 | Owens | 123/43 AA |
| 2,273,025 | 2/1942 | Dillstrom | 123/44 D |
| 2,408,800 | 10/1946 | Meyer | 123/44 D |
| 3,253,581 | 5/1966 | Nallinger | 418/117 |

FOREIGN PATENT DOCUMENTS

| | | | |
|---|---|---|---|
| 634514 | 2/1962 | Italy | 123/44 D |

*Primary Examiner*—Michael Koczo, Jr.
*Attorney, Agent, or Firm*—Buell, Blenko, Ziesenheim & Beck

[57] ABSTRACT

A two-cycle rotary internal combustion engine of the fuel injection type. A rotor having three radially disposed cylinders in equally spaced angular relation in a circular rim rotates in sealed rotation within a cylindrical stationary outer housing. The respective pistons in the cylinders are connected to the same crank arm of the crankshaft, which is in turn connected, through a planetary gear mechanism, to rotate in the same direction and at a three-to-one ratio of speed to the rotor. The outer housing has two exhaust ports and two fuel injectors in angularly spaced relation to which the cylinders are opened in timed sequence. Fresh air is supplied under pressure into the closed housing in surrounding relation to the cylinders for cooling the cylinders and for preheating scavenging air admitted to the interior of the cylinders through ports therein. Jets of air, provided by a hole in the rim behind each cylinder, serve to assist in combustion of hydrocarbons in the exhaust gases and also dilution of particulates. In a modified embodiment, the crankshaft and rotor rotate reversely and in three-to-one speed ratio with four exhaust ports and four fuel injectors in substantial quadrature relation in the housing. Various forms of cylinder seal rings are disclosed. One embodiment comprises a tapered split ring seated in a tapered groove. In another embodiment of seal ring a plurality of tapered split rings are assembled into a composite close-fitting concentric relation. Other embodiments of seal rings comprise a solid (non-split) ring with associate split rings to seal against the wall of the groove and with the circular housing.

7 Claims, 30 Drawing Figures

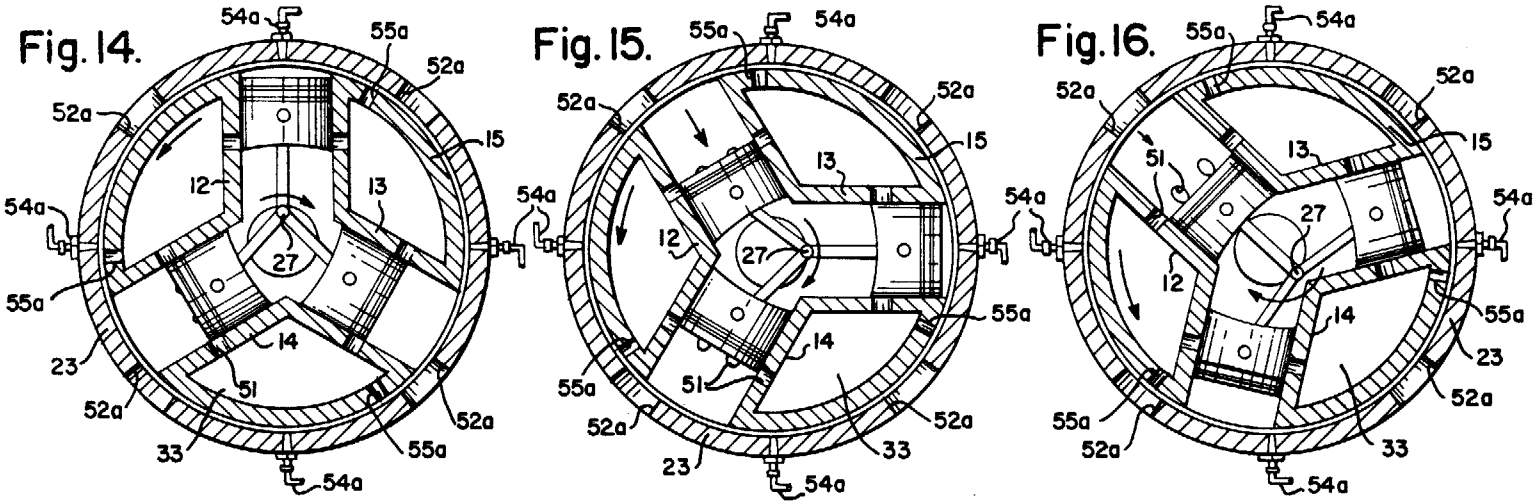
Fig. 14.
Fig. 15.
Fig. 16.
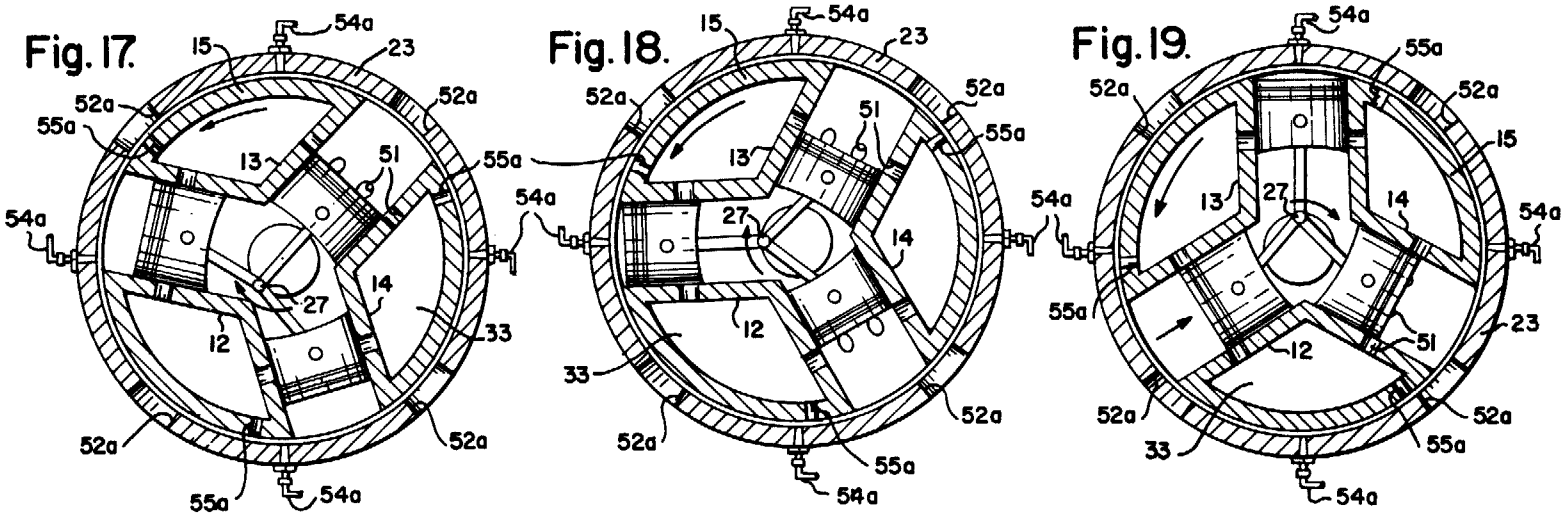
Fig. 17.
Fig. 18.
Fig. 19.

Fig. 20.
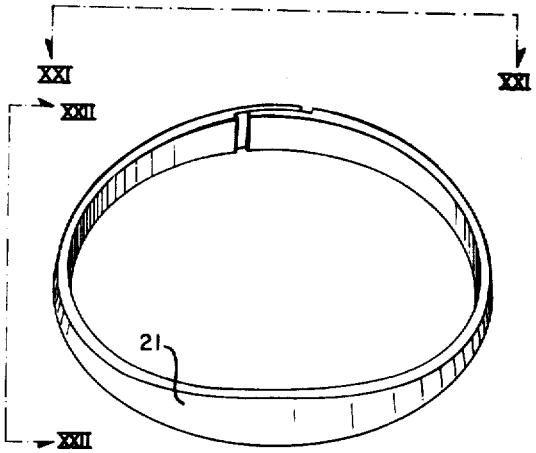
Fig. 24.
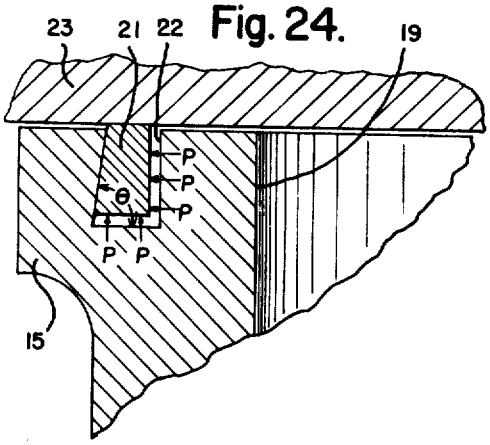
Fig. 21.
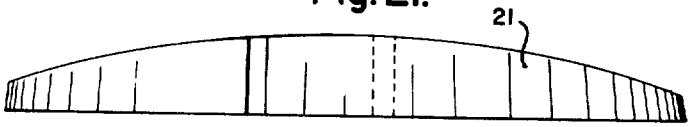
Fig. 22.
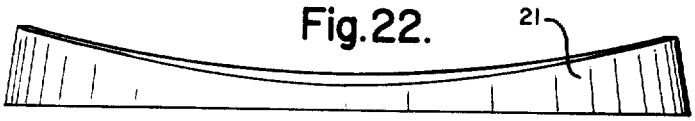
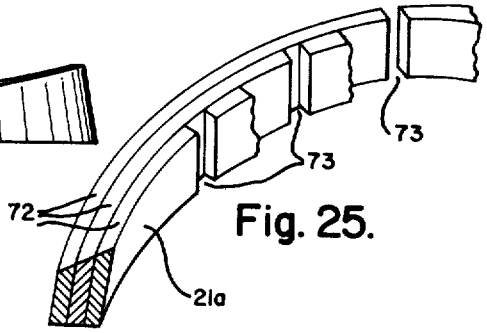
Fig. 25.
Fig. 23.
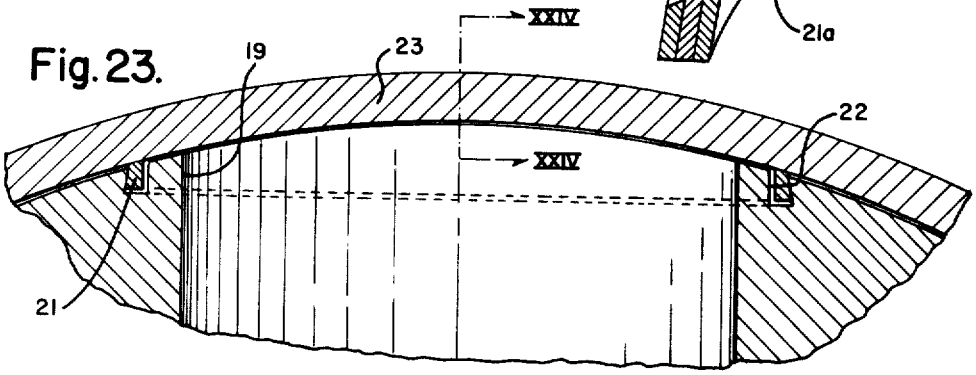

TWO CYCLE ROTARY INTERNAL COMBUSTION ENGINE AND CYLINDER SEALING RING ARRANGEMENT THEREFOR

This application is a continuation-in-part of my prior copending application Ser. No. 838,383, filed Sept. 30, 1977, now U.S. Pat. No. 4,136,646.

This invention relates to two cycle rotary internal combustion engines of the fuel injection type and to cylinder sealing ring arrangements therefor.

One of the most efficient internal combustion engines is the modern two-cycle diesel engine with fuel injection and scavenging with aid of an auxiliary air pump, of which the so-called Detroit diesel is an example. Engines of this type are used principally in large trucks and buses. When reduced in size for applications requiring lesser horsepower output, such as in smaller passenger vehicles, motorcycles, outboard motors and the like, such engines are no longer practical by reason of the upper limit of R.P.M. imposed by the valve train, which is required to operate at twice the speed of that in a normal 4-cycle engine valve train for a given output shaft R.P.M. Thus, there is a practical limit to horsepower output obtainable from smaller sizes of such engines.

In the normally aspirated two-cycle engines, such as used in motorcycles, outboard motors, power lawn mowers and the like, the exhaust port is cut into the cylinder wall as is the fuel intake port. This arrangement causes several undesirable effects, tending to reduce efficiency, torque, horsepower flexibility and fuel mileage, not to mention the increase in pollution. With symmetrical exhaust timing, such as required in the two-cycle engine, the closing point of exhaust is automatically fixed. This results in loss of a portion of the fresh charge through the exhaust port on the compression stroke and a shortened duration of the effective power stroke.

In addition, with the exhaust port cut into the cylinder wall, there is less space left for the transfer ports which necessarily reduces their total opening area and, in consequence, results in poor scavenging air flow. Furthermore, the port location is also a cause of heat distortion to the cylinder wall due to heat concentration, and the close proximity of the transfer ports to the exhaust ports causes short circuiting of a portion of the fresh charge to the exhaust port. In consequence of the above physical relations and effects, the efficiency of operation is reduced and fuel consumption also is increased.

It is one of the objects of my invention to provide a two-cycle engine of the fuel injection type which partakes of the characteristics of a diesel engine to the extent of eliminating the deficiencies of the ordinary two-cycle engine and of drastically reducing the disadvantages thereof.

In my prior U.S. Pat. No. 4,010,719 issued Mar. 8, 1977, I have disclosed an arrangement for utilizing the rotary engine principle in a 4-cycle engine. My present invention differs in principle from that of my prior patent as well as that of the reference patent art cited therein, such as Cantoni Pat. No. 2,242,231.

It is another object of my invention to provide a two-cycle engine of the hereinbefore mentioned type wherein the housing structure is simplified to provide ease of assembly and disassembly, preheating of scavenging air and cooling of the cylinders, and high surface to volume ratio of the cylinders enabling the burning of heavier fuels with lower octane rating.

It is another object of my invention to provide, in an engine of the type hereinbefore described, for the supply of jets of air to the exhaust gases following closure of the exhaust port to cause combustion of hydrocarbons and dilution of particulates in the exhaust gases, thereby reducing pollution of ambient air.

It is another object of my invention to provide, in a rotary engine of the hereinbefore described type, cylinder seal rings which counteract the effect of centrifugal force thereon, to reduce the braking effect on the rotor, as well as wear on the rings, caused by friction.

It is another object of my invention to provide other forms of cylinder seal rings comprising a combination of a solid (non-split) ring and one or more auxiliary split rings which engage the wall of the groove in which the ring is located and/or the interior surface of the circular housing.

For the attainment of the aforesaid objects, my invention comprises a rotary cylinder block of three open-end radial cylinders supported in spaced angular relation by a circular rim. The cylinders have sealed contact with the inside surface of a circular housing by means of cylinder rings which are so designed in relation to the cross-sectional configuration of the circular groove in which they are located as to utilize a component of the compression pressure in the cylinders exerted on the rings to partially counteract the centrifugal force exerted on the rings, and thereby reduce the braking effect on the rotor and wear on the rings. I am aware of U.S. Pat. No. 1,915,582 which disclosed a cylinder ring of different construction and principle for a similar purpose.

The circular housing is closed at opposite ends by end covers, one of which provides an intake manifold volume for fresh scavenging air supplied thereto under pressure by an auxiliary pump. The said one end cover also provides at least partial support for a planetary gear mechanism by which a rotational speed ratio of one-to-three is effected between the rotary cylinder block and the crankshaft supported by bearings in the cylinder block.

I further provide for circulation of scavenging air from the manifold throughout the interior of the housing both for the purpose of cooling the cylinders and for preheating the scavenging air which is admitted through ports in the cylinder walls.

I further provide in the circular rim supporting the cylinders of the rotary cylinder block, a series of ports or holes respectively located behind each cylinder through which jets of fresh air from the scavenging manifold and interior of the circular housing are supplied into the hot gases discharged into the exhaust manifold. Combustion of hydrocarbons in the exhaust gases and dilution of particulates therein is thus promoted and ambient air pollution reduced.

I further provide a modified structure of rotary engine in which the number of power strokes per cylinder for each revolution of the crankshaft is increased without increasing the speed of the crankshaft or of the rotary cylinder block. This is done by providing a planetary gear mechanism so arranged between the rotary cylinder block and the crankshaft as to cause them to rotate concurrently in opposite directions. In this modification greater power output capability is attained with no increase in the physical size of the engine of the first described embodiment. I am aware of the disclosure in my prior patent and in U.S. Pat. No. 3,857,371 of a rotary engine in which the cylinders and crankshaft rotate oppositely in a predetermined ratio.

A more detailed description of my invention is provided hereinafter in connection with the accompanying drawings, wherein:

FIGS. 14 through 19 are cross-sectional views representing diagrammatically the relative positions of the rotary cylinder block, pistons and crankshaft at different stages of operation of an individual piston for one complete revolution of the crankshaft;

FIG. 20 is a perspective view of one of the cylinder rings employed in the two embodiments shown in FIGS. 1 and 11;

FIGS. 21 and 22 are elevational views of the cylinder ring of FIG. 20 looking in the direction of arrows XXI and XXII respectively;

FIG. 23 is an enlarged sectional view at a right angle to that in FIG. 1 showing a cylinder seal ring and the circular groove in which it is mounted;

FIG. 24 is a sectional view, on slightly enlarged scale, of a cylinder ring and its groove taken on the line XXIV-XXIV of FIG. 23;

FIG. 25 is a fragmental perspective view showing a modified embodiment of cylinder seal ring;

Figure 1:
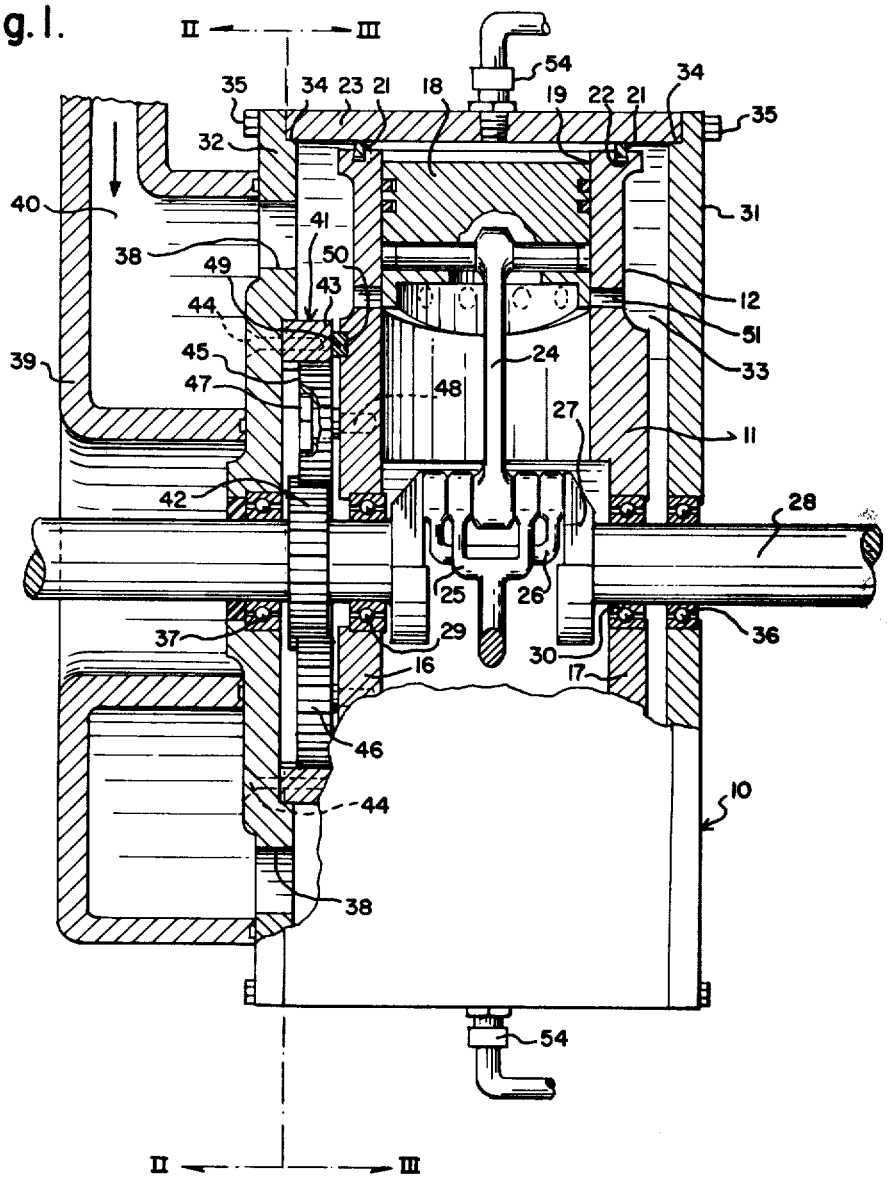
FIG. 1 is a view, partially in cross-section, showing a preferred embodiment of a rotary internal combustion engine disclosing my invention.
Figure 3:
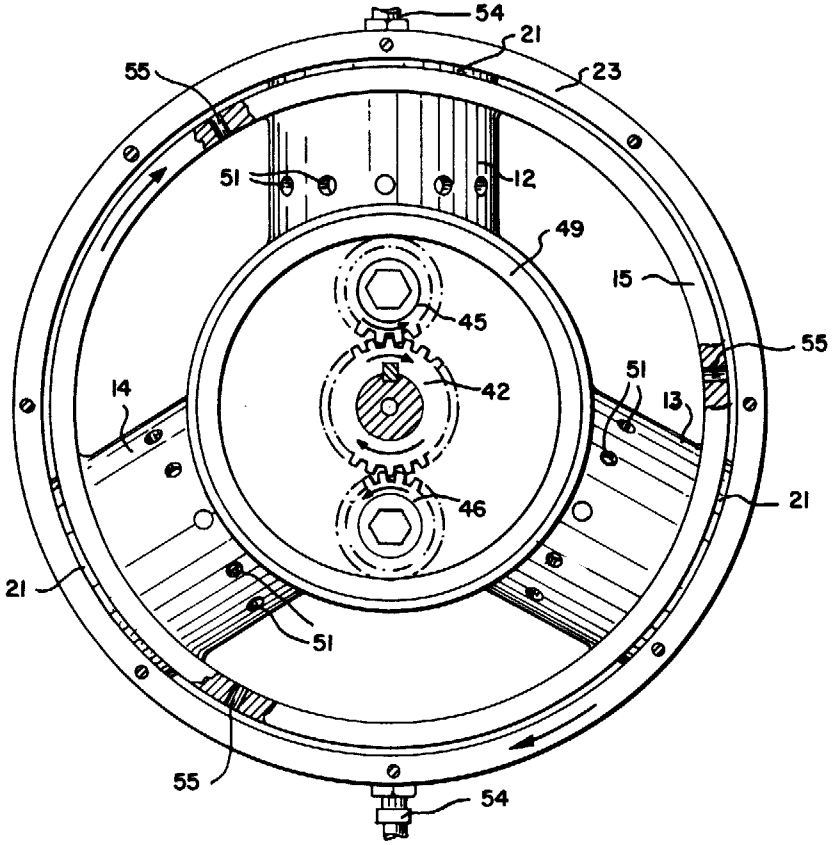
FIGS. 2 and 3 are sectional views taken generally on the lines II and III respectively of FIG. 1 and on slightly reduced scale showing additional details.
Figure 2:
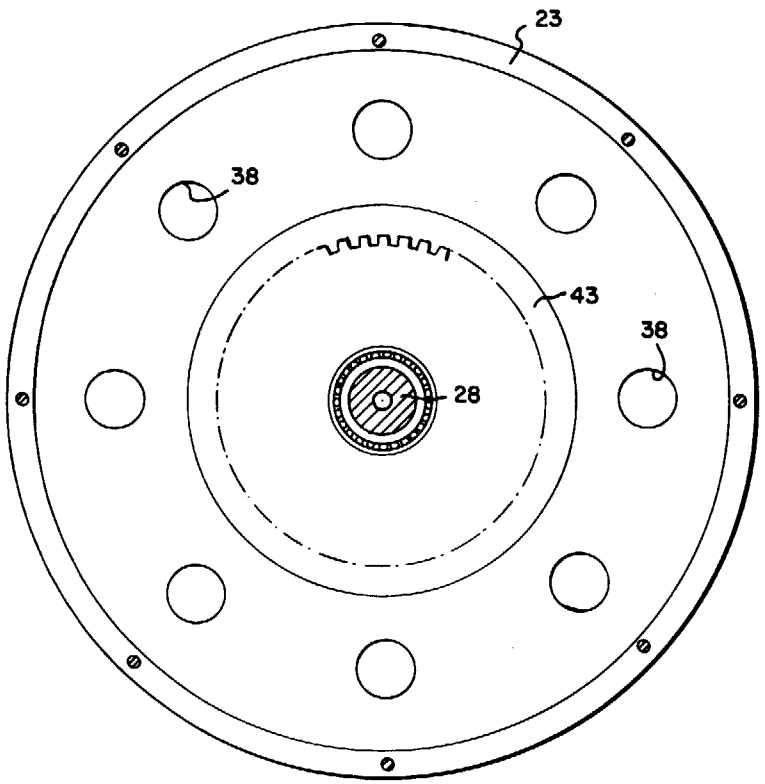

Referring to FIGS. 1, 2 and 3 of the drawing, a preferred embodiment of rotary internal combustion engine 10 comprises a cylinder block 11 having three radially arranged cylinders 12, 13 and 14 disposed in equally spaced angular relation. The outer extremities of the cylinders are supported by means of a circular rim 15 and the inner extremities are joined at each side by connecting annular members 16 and 17, respectively. Rim 15 and members 16 and 17 are preferably cast integrally with the cylinders, though they may be formed of separate sections mechanically joined to the cylinders.

Each cylinder has a piston 18 that operates within a bore 19 which is open at the outer end thereof. Each piston is provided with conventional compression rings engaging the wall of the bore 19. Each cylinder is, furthermore, provided with a seal ring 21 (FIGS. 20-24) mounted in a groove 22 formed or cut in the circular rim 15 is coaxial relation to the axis of the bore 19. As will be seen from FIGS. 21 and 22, particularly, each seal ring 21 is ground to seal against the interior circular surface of a circular housing 23. To counteract the outwardly acting centrifugal force acting on the seal rings 21, the outer circular surface thereof is milled or ground at an angle, in the range of 75°-85°, to the flat base of the ring. The outer wall of groove 22 is correspondingly sloped so that a component of the compression pressure acting on the inner surface of the ring (FIG. 24) serves to oppose at least partially the outwardly acting centrifugal force. By thus limiting the friction of the rings 21 on the interior surface of housing 23, wear on the rings is reduced. Moreover, the braking effect to rotation of the cylinder block 11 is minimized and operation of the engine is made feasible.

The three pistons 18 are respectively coupled by corresponding connecting rods 24, 25 and 26 to a common crank arm 27 on a crankshaft 28. It will be seen that connecting rod 25 is formed with a clevis by which to straddle the central rod 24 at its seat on the crank arm 27. Similarly the rod 26 has a clevis which straddles that of rod 25 at the seat on the crank arm. It will be seen, therefore, that the axes of all three cylinders 12, 13 and 14 are in a common plane.

Crankshaft 28 extends horizontally through aligned openings in the annular members 16 and 17 and is supported by suitable bearings 29 and 30 in the openings.

There are two end covers 31 and 32 at opposite ends of the circular housing 23 for providing a chamber 33 around the cylinders. Each of the end covers has a peripheral circular shoulder 34 on which the circular housing seats for holding the end covers in centered relation to the housing 23. A series of suitable bolts 35 in angularly spaced relation serve to secure the end covers to the housing. End covers 31 and 32 are provided with central bearings 36 and 37 respectively which provide additional outboard support for the crankshaft.

End cover 32 is provided with a series of circularly arranged holes 38, in spaced relation to each other, through which scavenging air flows to the chamber 33 from an annular manifold 39 that is secured in sealed relation to the outer face of the end cover in surrounding relation to the crankshaft 28. While omitted for simplicity, it should be understood that an auxiliary pump (not shown) is provided for supplying air under pressure through an entrance passage 40 of the manifold 39.

Interposed between the end cover 32 and the cylinder block 11 is a planetary gear mechanism 41 by which rotation of the cylinder block and that of the crankshaft are coordinated to rotate in the same direction and in a speed ratio of one to three. That is, the crankshaft 28 makes one full revolution while the cylinder block 11 rotates through 120°.

Planetary gear mechanism 41 comprises a central spur gear 42 fixed on the crankshaft, an outer ring gear 43, attached as by a plurality of screws 44 to the interior surface of the end cover 32, and two intervening idler gears 45 and 46 respectively, disposed on diametrically opposite sides of the spur gear 42 and meshing with the spur gear 42 and ring gear 43. The idler gears 45 and 46 are rotatively mounted on bolts 47, the reduced diameter ends of which are threadably engaged in tapped bores 48 provided in the annular member 16. A wear ring 49 of suitable metal, such as copper or bronze alloy, is inset in a recess 50 in the face of member 16 to assure proper spacing with the ring gear 43 on rotation of the cylinder block 11.

Each of the cylinders 12, 13 and 14 is provided in the wall thereof with a series of circularly arranged scavenging ports 51. As shown in FIG. 1, ports 51 are maintained closed by the skirt of the piston 16 in the top dead center position of the piston and, as will be made clear later on, are uncovered only in bottom dead center position of the piston at the conclusion of the power stroke of the piston. The circular housing 23 is provided with two diametrically opposite exhaust ports 52 (FIGS. 4–10). Accordingly, scavenging air flows from manifold 39 via holes 38 in end cover 32 to chamber 33, and while the piston uncovers the scavenging ports 51 in a cylinder, via the scavenging ports 51 and out through the corresponding exhaust ports 52. (See FIG. 7)

The circular housing 23 also has two diametrically spaced holes therethrough in each of which a fuel injector 54 is attached, as by screw threads. The fuel injectors 54 are connected through suitable hoses or conduit to the output line of fuel pumps (not shown) driven as by connection to the crankshaft and provide in conventional manner for an inshot of fuel into a cylinder at the instant a piston reaches its top dead center position, a position of maximum compression.

As shown in FIGS. 4–10, the rim 15 of the cylinder block 11 is provided with a plurality of ports 55, one behind each cylinder 12, 13 and 14, via which a jet of fresh air flows from the chamber 33 within the cylinder block to the exhaust port 52 after the bore 19 of a cylinder passes the exhaust port. The jets of fresh air flowing via ports 55 from chamber 33 to the exhaust manifold (not shown) into which the exhaust ports 52 open, serve to provide combustion air to the hydrocarbons which remain unburned in the exhaust gases. Furthermore, the fresh air flowing into the exhaust ports 52 and the exhaust manifold serves to dilute the concentration of particulates in the exhaust gases. Thus the ports 55 serve a useful function in reducing the pollution of the atmospheric air into which the exhaust gases are discharged from the exhaust manifold.

Referring now to FIGS. 4–10, the operation of the engine 10 will be briefly described for one of the cylinders, cylinder 12 for example, it being understood that the operation of the other two cylinders occurs similarly in timed sequence.

Figures 4, 5, 6, 7, 8, 9:
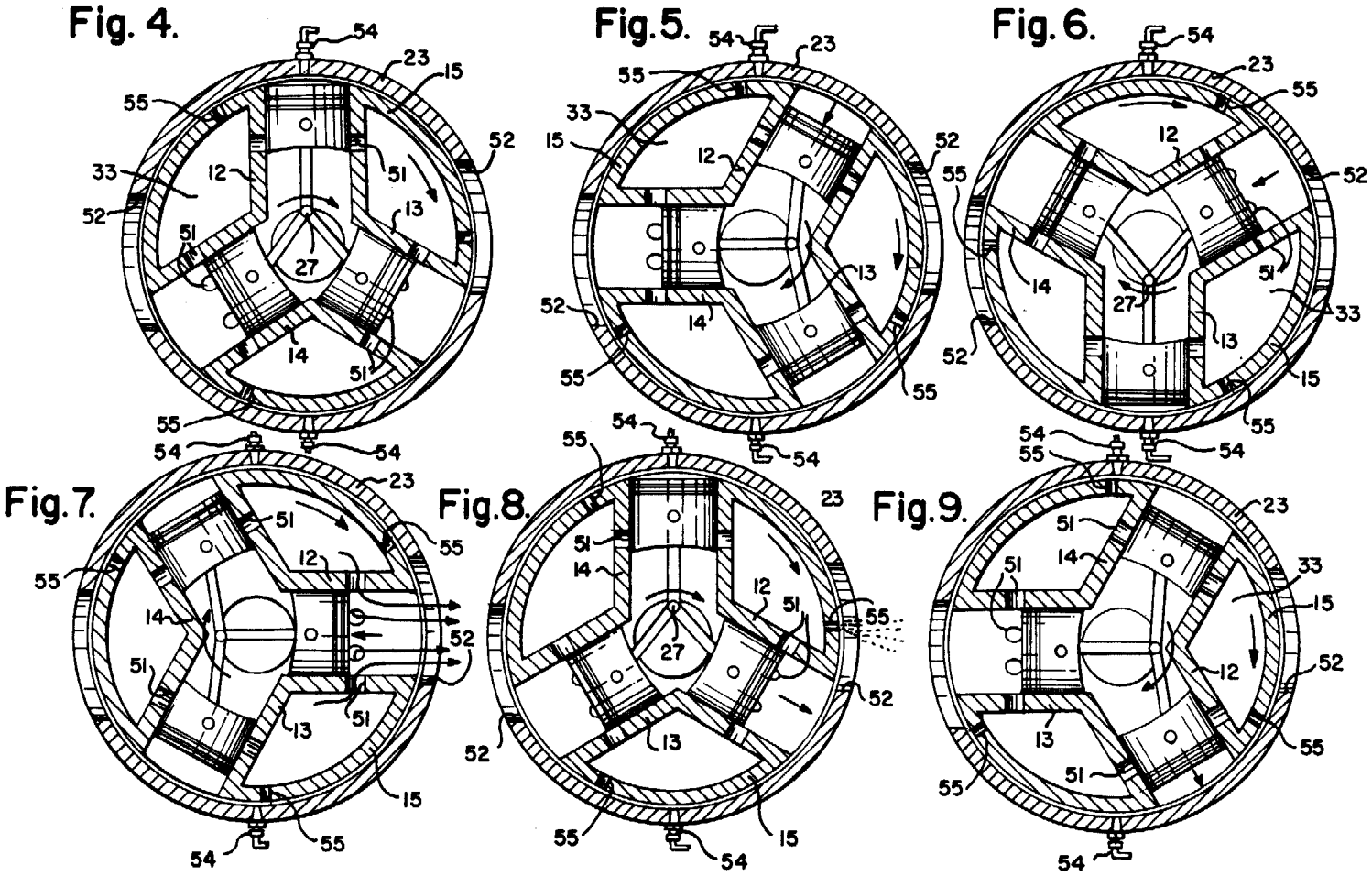
FIGS. 4 through 10 are cross-sectional views representing diagrammatically the relative positions of the rotary cylinder block, pistons and crankshaft at different stages of one complete cycle of operation of an individual piston from firing, through power stroke, exhaust, compressing, back to firing.

In FIG. 4, the piston 18 of cylinder 12 is at top dead center. At this instant of maximum compression in the cylinder, injection of fuel by the injector 54 results in explosive combustion of the fuel mixture in the cylinder bore 19 which drives the piston inwardly of the bore. FIG. 5 shows the relative positions of the cylinder 12 and the crankarm of the crankshaft, after the crankshaft has rotated 90° from the position in FIG. 4. It will be seen that the cylinder has rotated clockwise through 30° from its position in FIG. 4. It will be apparent that the speed of the crankshaft has a ratio of three-to-one with respect to the speed of rotation of the cylinder block. FIG. 6 shows the position of cylinder 12 corresponding to one-half revolution (180°) of the crankshaft, wherein the bore 19 is substantially open to the exhaust port 52 and releasing the burned gases to the exhaust port 52 and exhaust manifold. The piston 18 at this instant is just beginning to crack the scavenging ports 51 of cylinder 12 open. Accordingly, the burned gases in the bore of cylinder 12 do not flow back into chamber 33 to contaminate the fresh air therein, but rather flow out of the bore of the cylinder into the exhaust manifold. FIG. 7 shows piston 18 in cylinder 12 in its bottom dead center position at the termination of its power stroke, fully uncovering the scavenging ports 51 in the wall of cylinder 12. In this position, scavenging air at full pressure flows from chamber 33 through the scavenging ports 51 into the bore 19, as shown by the arrows in FIG. 7. Here again, it will be seen that the cylinder has moved through 90° from its original position whereas the crankshaft has rotated correspondingly through 270°. In this position of the cylinder, bore 19 is fully open to the exhaust port 52 and the connected exhaust manifold.

Figure 10:
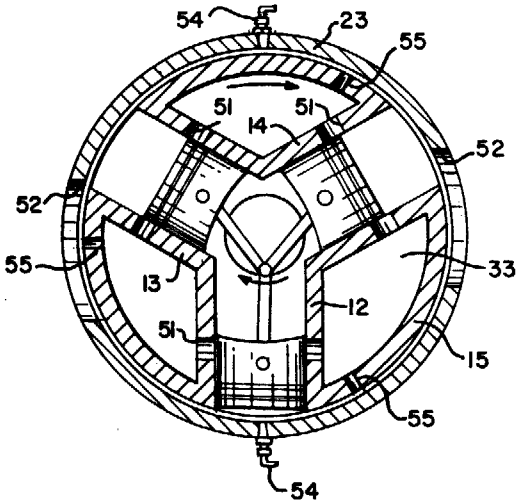

FIG. 8 shows the cylinder 12 still further advanced to the position in which the bore 19 of the cylinder has completely closed the exhaust port, but in which the associate port 55 is injecting a jet of high pressure air into the exhaust port and its connected exhaust manifold. Here again the scavenging ports are substantially covered by the piston preventing back flow of burned gases into chamber 33. From this instant therefore, compression of gases in the bore 19 begins and continues as the cylinder 12 rotates further (FIG. 9) while the piston 18 moves outwardly in the bore 19 toward top dead center position, as shown in FIG. 10. Here again the fuel injector injects fuel into the cylinder bore 19 causing an explosion of the fuel mixture in the cylinder bore and driving piston 18 into its combustion or power stroke, as before.

It will be apparent, therefore, that there are two firings per cylinder for a complete revolution of the cylinder. It will also be seen that at the instant the crankshaft completes one full revolution from the original position (FIG. 4) to that shown in FIG. 8, cylinder 14 reaches a position in which the injector 54 injects fuel into the bore of cylinder 14 and firing takes place. Thus, there are two firings for each revolution of the crankshaft.

Figure 11:
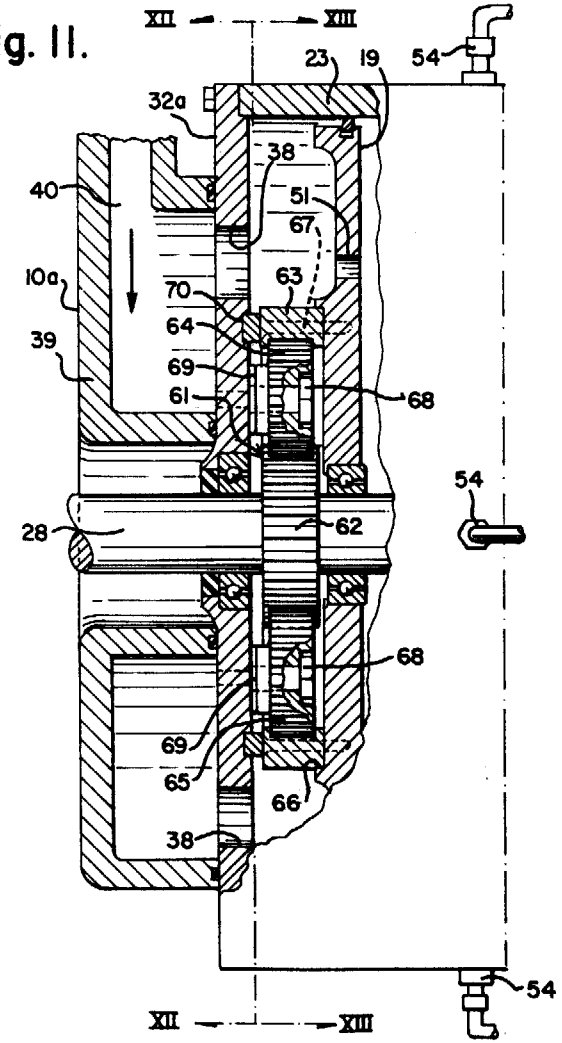
FIG. 11 is a fragmental view, partially in cross-section, of a modified embodiment of rotary internal combustion engine showing the planetary gear mechanism whereby reverse rotation of the cylinder block with respect to the crankshaft is effected.
Figure 13:
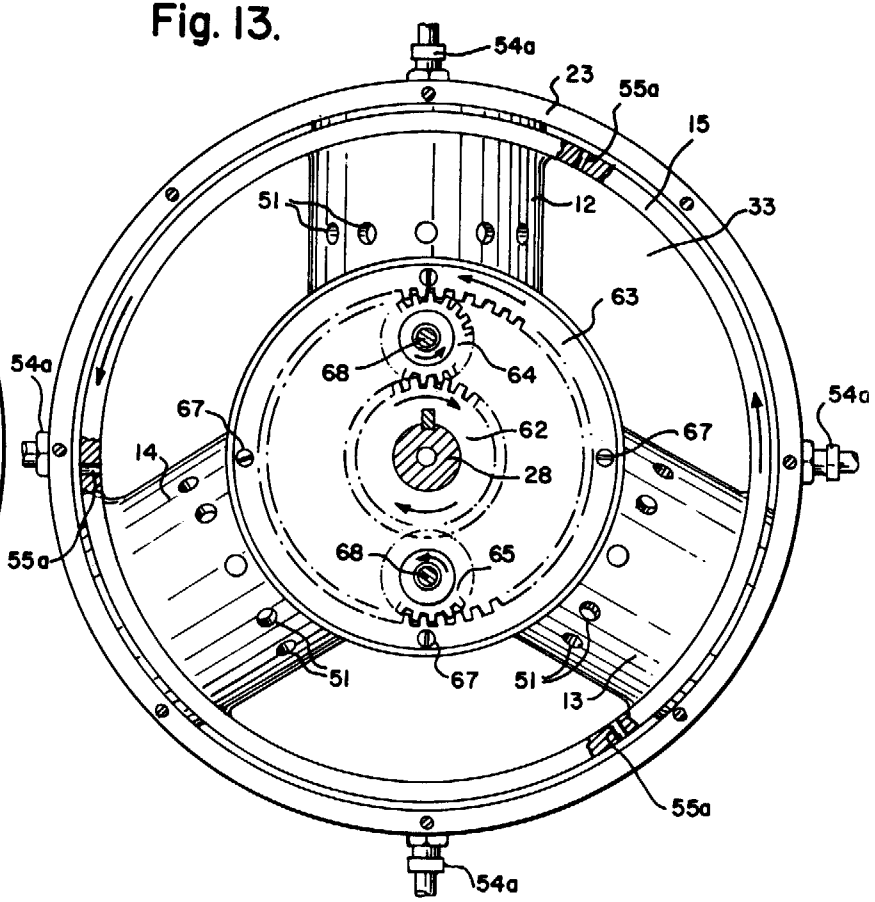
FIGS. 12 and 13 are sectional views taken generally on the lines XII and XIII of FIG. 11 and on slightly reduced scale showing additional details.
Figure 12:
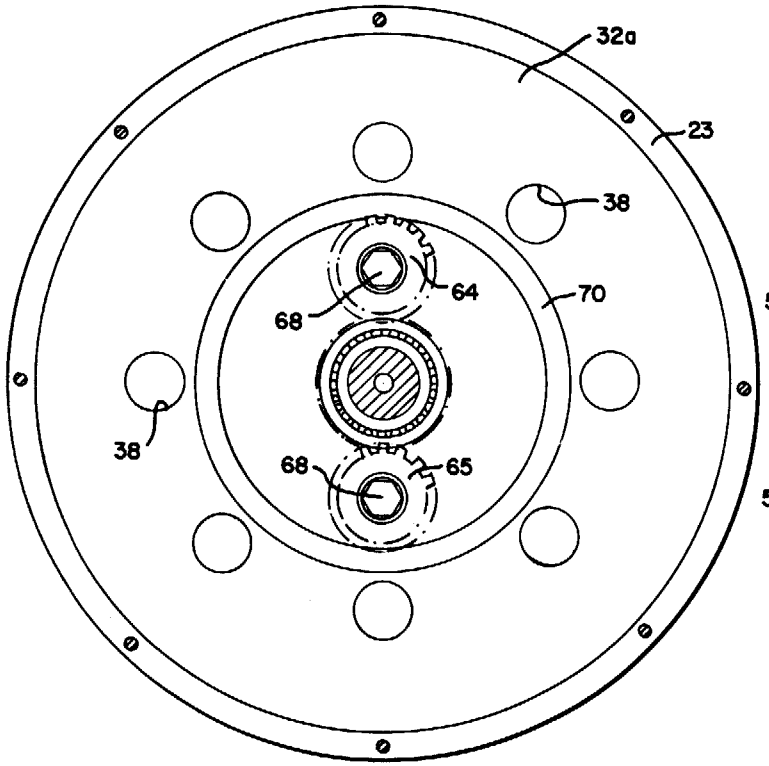

Referring to FIGS. 11, 12 and 13, a modified embodiment of engine 10*a* is shown which is essentially the same as engine 10 except in respect of the providing of a different arrangement of the planetary gear mechanism 61. Corresponding parts in the two embodiments are thus designated by the same reference numerals without further description and further description of the modified engine 10*a* will be limited to a description of the planetary gear mechanism 61 and to such other differences as are required.

The planetary gear mechanism 61 is so arranged as to cause the cylinder block 11 to rotate in a direction opposite to that of the crankshaft 28. Moreover, the crankshaft is driven at a speed three times faster than that of the cylinder block. As shown in the drawings, planetary gear mechanism 61 comprises a spur gear 62, fixed on the crankshaft 28, a ring gear 63 fixed on the cylinder block 11 in concentric relation to the spur gear 62, and two idler gears 64 and 65 interposed in meshing relation on diametrically opposite sides of the spur gear 62 between the spur gear and the ring gear 63.

Ring gear 63 is secured within an annular recess 66 in the side wall of cylinder block 11 by a series of angularly spaced screws or bolts 67. Idler gears 64 and 65 are rotatively mounted on bolts 68 which are screwed into tapped holes 69 in end cover 32*a*. The shank of the bolts 68 is stepped, a larger diameter portion adjacent the head having a smooth bearing surface, and the end portion being threaded. The shoulder thus formed on the shank of the bolts 68 serves as a stop to limit the amount bolts 68 may be screwed into the tapped holes. A spacing washer 69 may be provided, as shown, between the projecting hub end of the idler gears 64 and 65 and the end cover 32*a*. As shown in FIG. 11, the idler gears 64 and 65 are recessed at the end opposite to the projecting hub end to receive the heads of the bolts 68. A wear ring 70, of suitable metal, such as copper or bronze alloy, is secured in an annular recess in the end cover 32*a* opposite the ring gear 63.

Engine 10*a* further differs from engine 10 in having twice the number of fuel injectors 54*a* and twice the number of exhaust ports 52*a*. Injectors 54*a* are in substantial quadrature positions on the circular housing 23, as shown in FIGS. 14–19. Exhaust ports 52*a* are located in the circular housing 23 substantially midway between the fuel injectors 52*a*.

Another difference between engine 10*a* and engine 10 lies in the fact that three air jet ports 55*a*, corresponding to jet ports 55, are located adjacent each cylinder 12, 13 and 14 in the rim 15 but on the opposite side. This is the case because of the fact that the cylinder block 11 in engine 10*a* rotates reversely to that of cylinder block 11 in engine 10 and also reversely to the direction of rotation of the crankshaft 28.

Referring to FIGS. 14–19, a brief description of the operation of one cylinder, such as cylinder 12, for one revolution of the crankshaft will now be given.

As seen in FIG. 14, the piston in cylinder 12 is in its top dead center position. Assuming that firing takes place, the crankshaft rotates clockwise as indicated by the arrow, while the cylinder block 11 rotates counterclockwise as shown by the arrow. In FIG. 15, the piston has moved downwardly in the bore of the cylinder to a position in which the exhaust port 52*a* is uncovered substantially, allowing exhaust of burned fuel. In the next position, shown in FIG. 16, the piston has fully uncovered the scavenging ports 51 in cylinder 12, a position in which the scavenging air from chamber 33 flows into the cylinder bore and out through the exhaust port 52*a*.

In FIG. 17, the bore of cylinder 12 has moved past the exhaust port 52*a* and the piston is moving upwardly in the bore to compress the air therein. At this instant, the air jet port 55*a* behind the cylinder 12 has moved into line with the exhaust port and is injecting air from the chamber 33 into the exhaust port 52*a* and its connected exhaust manifold.

In FIG. 18, the piston of cylinder 12 has reached its top dead center position again, fuel injector 54*a* injects fuel, and the mixture in the cylinder bore fires, driving the piston downwardly into the cylinder bore to a position in which the crankshaft reaches and completes one complete revolution. It will thus be seen, that while the crankshaft rotates through 360°, the cylinder block has rotated only through 120°.

By analyzing the operation of the cylinders 13 and 14 concurrently with that of cylinder 12, it will be seen that there are actually four firings for one crankshaft revolution. Consequently, engine 10*a* provides double the number of power strokes, per unit of time, compared to engine 10 and this with no increase in the speeds of the cylinder block or crankshaft. Consequently, engine 10*a* is an exceptionally powerful engine of relatively small size. It is possible, by providing a number of engines 10*a* in tandem, to provide an sufficiently powerful engine for small passenger car applications.

One of the novel features utilized in both engines 10 and 10*a* resides in the cylinder seal rings 21. By providing seal rings 21 so designed as to have the outside surface thereof sloped at an angle in the range of 75°–85° with respect to the horizontal base thereof, and providing correspondingly sloped grooves 22 in the rim 15 concentrically to the bore 19 of each cylinder, it is possible to kimit the centrifugal force acting on the cylindrical seal rings which is effective by contact with the stationary circular housing to exert a braking effect to rotation of the cylindrical block 11. Unless thr braking effect exerted by the cylinder seal rings, in the rim of the cylindrical block, is properly limited and controlled, effective operation of the engine itself is prevented. Thus, by providing cylinder seal rings designed to limit and control the centrifugal force acting on the rings, practical and feasible operation of the engines is made possible.

Referring to FIG. 25, a modified form of cylinder seal ring 21*a* is shown, which may be substituted for the rings 21 shown in the engine 10 and 10*a*. Ring 21*a* differs from ring 21 in being made up of a plurality, illustrated as three in number, of concentric closely fitting separate split rings 72, the end separation spaces 73 of which are in staggered relation to prevent leakage therethrough. Rings 72 are preferably of uniform thickness and tapered at an angle of 75°–85° to the base.

After assembly into an integral ring, the rings 72 are then ground to provide an overall contour similar to that of ring 21, shown in FIG. 20, in which the upper edge has a circular contour corresponding to the curvature of the inner surface of the circular housing 23.

Figure 26:
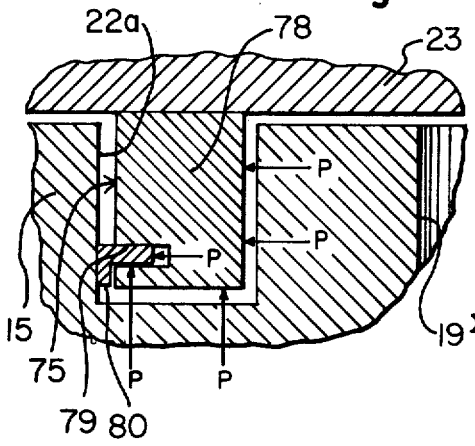
FIGS. 26 and 27 are fragmental sectional views similar to that of FIG. 24 showing other embodiments of a cylinder seal ring employing a combination of a solid (non-split) ring and a split ring.
Figure 28:
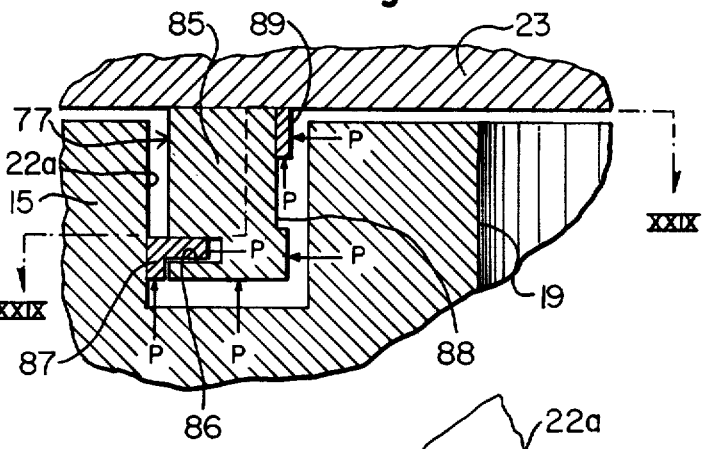
FIG. 28 is a fragmental sectional view similar to that of FIG. 24 showing another embodiment of a cylinder seal ring employing a combination of a solid (non-split) ring and two auxiliary split rings, one of which seals on the wall of the ring groove and the other of which seals on the circular housing.
Figure 27:
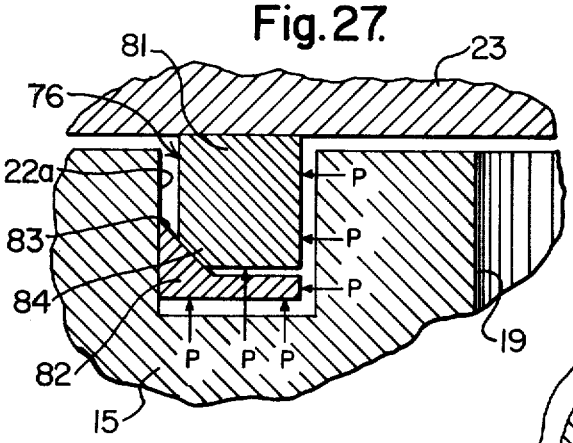
Figure 29:
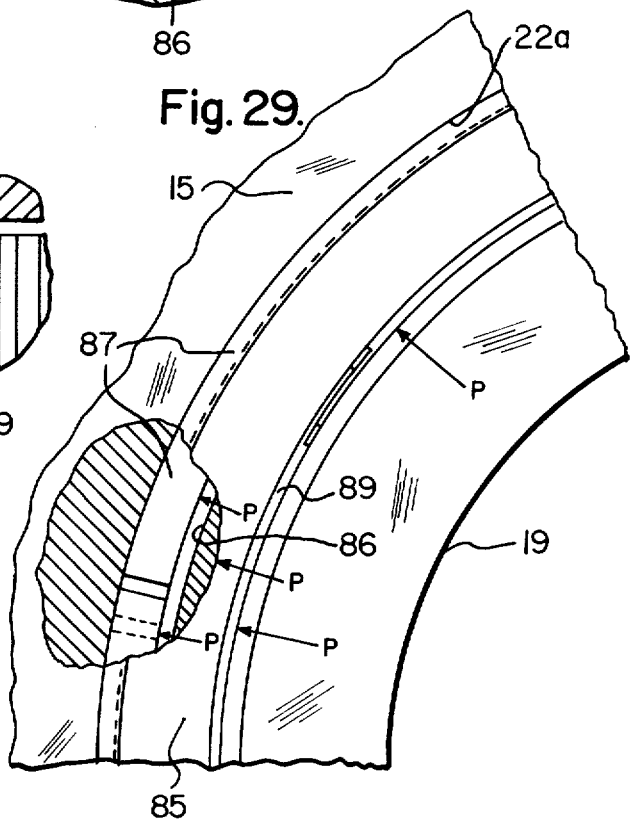
FIG. 29 is a fragmental sectional view taken generally on the line XXIX-XXIX in FIG. 28 showing additional details of the cylinder sealing ring shown in FIG. 28.

Other forms of cylinder sealing rings 75, 76 and j77 are shown in FIGS. 26, 27 and 28, respectively. All these rings are similar in that they are adapted to fit in a ring groove 22*a*, of rectangular cross-section and varying depth, open to the inside surface of the circular housing 23.

Sealing ring 75 comprises a main ring element 78 which is of a rigid integral (non-split) construction and rectangular cross-section. The ring element 78 is ground to a circular surface on the outer periphery so as to seat on the circular interior surface of the circular housing. Thus, circumferentially the ring element varies in depth, after the manner of ring element 21. (See FIG. 20) The cross-sectional dimension of ring element 78 are such as to provide clearance therewith in ring groove 22*a*, by which the pressure P of the gases compressed in cylinder bore 19 acts on the ring element to assist in supporting it in position within the ring groove and in sealing contact with the circular housing 23.

The ring element 78 has an annular groove 79 in the outer periphery thereof containing a split ring 80 of L-shaped cross-section which seats on the outer wall of the ring groove 22*a* to which it is pressed by the pressure P of the compressed gases acting thereon within the groove 79 and in the clearance space within the ring groove 22a.

Sealing ring 76 comprises a rigid integral main ring element 81 of generally rectangular cross-section and varying depth providing clearance space therearound within the groove 22a and ground to a circular configuration so as to seat on the internal circular surface of the housing 23. Associated with the main ring element 81 is an auxiliary split ring 82 having a peripherally sloped surface 83 thereon that seats on a correspondingly sloped or beveled peripheral corner 84 of the main ring element. As will be seenin FIG. 27, the pressure P of the gases compressed in bore 19 are effective to press the main ring element 81 into sealing contact with the circular housing 23, both directly and through the sloping surface 83 of auxiliary split ring 82. Also, the pressure P within the groove 22a acts directly on the ring 82 and through the main ring element 81 to press the split ring 82 into contact with the outside wall of groove 22a.

The sealing ring 77 is similar to rings 75 and 76 in that it has a rigid integral main ring element 85 of generally rectangular cross-section and varying depth providing clearance space therearound within the groove 22a and ground to a circular configuration so as to seat on the internal circular surface of the circular housing 23. Ring element 85 has an annular groove 86 on its outer periphery in which is a split ring 87 of L-shaped cross-section. Ring 87 is pressed into sealing contact with the outer wall of the ring groove 22a by pressure P of the compressed gases from bore 19.

Figure 30:
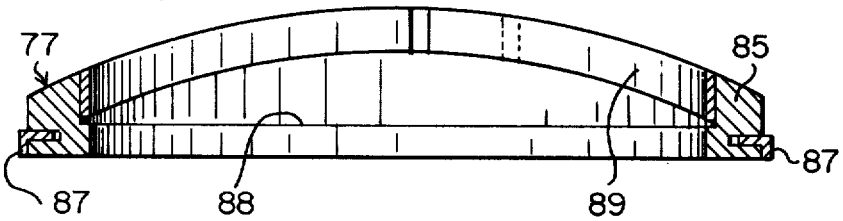
FIG. 30 is a diametrical sectional view of the ring of FIG. 28 on reduced scale taken at a right angle to the view of FIG. 28 showing particularly the configuration of the auxiliary split ring which seals on the circular housing.

The inner periphery of ring element 85 has a recess 88 formed therein in which rides an auxiliary split ring 89 (See FIG. 30) which is ground circularly to seat on the interior circular surfaces of circular housing 23. Auxiliary ring 89 is pressed to the interior surface of the housing 23 and to the ring 85 by the pressure P of the gases compressed in the bore 19. Due to the fact that ring 89 is more flexible than ring 85, it can follow irregularities in the interior surface of housing 23 more effectively than the rigid ring 85. Sealing ring 77 thus provides an improved sealing action over the sealing rings 75 and 76.

In conclusion, it will be seen that I have provided a two-cycle engine of novel design having a high surface to volume ratio and capable of operation by fuels of lower octane ratings. Moreover, I have provided a novel structural design of engine which enables ease of assembly and disassembly of parts with no unusual know-how or skills.

I have further provided several cylinder seal rings of novel construction which make practical operation of rotary cylinder engines of the aforesaid design possible.

I have further provided a practical rotary engine in which scavenging of the cylinders is effected by fresh air from auxiliary pumps circulated through the housing, thereby preheating the scavenging air and at the same time cooling the cylinders.

I have also provided means for utilizing jets of fresh air from the scavenging air in the engine housing to cause combustion of unburned hydrocarbons in the exhaust gases well as dilution of particulates therein, all for the purpose of reducing pollution of atmospheric air which would otherwise result.

In the foregoing specification I have described presently preferred embodiments of my invention; however, it will be understood that my invention can be otherwiseembodied within the scope of the following claims.

I claim:

1. A two-cycle internal combustion engine having a rotary cylinder block comprising a plurality of radially arranged angularly spaced cylinders supported at their outer extremities by an annular rim member, each cylinder having a bore opening at its outer end and having a piston reciprocable therein, said pistons being connected to a common crank arm of a crankshaft, a circular housing within which said rotary cylinder block rotates, said housing having a series of exhaust ports and fuel injectors arranged circumferentially in angularly spaced relation with which said open-ended bores sequentially register, wherein the improvement comprises means providing a sealed contact between each cylinder and said circular housing, said means including a split sealing ring having overlapping ends, and an annular groove in said annular rim in concentric surrounding relation to the open end of the bore of each of said cylinders in which said split sealing ring is disposed, said groove varying in depth circumferentially and said ring varying in height circumferentially so as to conform in contour to the circular interior surface of said circular housing, the peripheral outer surface of each of said split sealing rings sloping at a steep angle, in the range of 75°-85° to the base, and the outer wall of said groove most remote from the cylinder bore sloping correspondingly, whereby a component of the force exerted on said ring in said groove due to cylinder gas pressure at least partially counteracts the effect of centrifugal force acting to press said ring to the contact surface on said circular housing.

2. In a two-cycle internal combustion engine having a rotary cylinder block comprising a plurality of radially arranged angularly spaced cylinders supported at their outer extremities by an annular rim member, each cylinder having a bore opening at its outer end and having a piston reciprocable therein, said pistons being connected to a common crank arm of a crankshaft, a circular housing within which said rotary cylinder block rotates, said housing having a series of exhaust ports and fuel injectors arranged circumferentially in angularly spaced relation with which said open-ended bores sequentially register, the improvement comprising means providing a sealed contact between each cylinder and said circular housing, said means including a composite ring having a plurality of individual split rings of substantially uniform thickness and different diameters respectively arranged in closely fitting concentric relation, the ends of the different individual rings terminating short of each other to provide corresponding spaces which spaces are circumferentially staggered with respect to each other, and an annular groove in said annular rim in concentric surrounding relation to the open end of the bore of each of said cylinders in which said composite ring is disposed, said groove varying in depth circumferentially and said composite ring varying correspondingly in height circumferentially to conform in contour to the circular interior surface of said circular housing.

3. A two-cycle internal combustion engine according to claim 2, wherein each individual ring of the said composite ring slopes at a uniform angle to the base thereof, in the range of 75°-85°, and the outer wall of said groove most remote from the cylinder bore slopes correspondingly, thereby to cause a component of the force exerted on the composite ring in said groove due to cylinder gas pressure to at least partially counteract the effect of centrifugal force acting to press the composite ring to the contact surface on said circular housing.

4. A cylinder seal ring for a rotary cylinder engine of the type having a stationary housing with a circular interior surface within which a block of radial cylinders rotates, said seal ring comprising a circular split ring member having overlapping end portions adapted to fit in a corresponding circular groove in the outer surface of said block of cylinders, said ring member having a flat base and an upper edge ground circularly to conform in contour to and to seat on the circular interior surface of the stationary housing, and being further characterized in that the outer peripheral surface of said ring member slopes toward the inner surface at an angle to the base in the range of 75°-80°.

5. A cylinder seal ring for a rotary cylinder engine of the type having a stationary housing with a circular interior surface within which a block of radial cylinders rotates, said seal ring comprising a plurality of separate split rings of different diameters respectively, fitted into close concentric contact with one another, the ends of each of the individual rings having a space therebetween and the spaces for the different rings being in staggered circumferential relation with respect to each other, said rings having a common flat base and having their upper edges ground circularly to conform in contour to and seat sealingly on the circular interior surface of the stationary housing of the engine.

6. A cylinder seal ring for a rotary cylinder type of engine according to claim 5, wherein the individual rings are substantially of uniform thickness.

7. A cylinder seal ring for a rotary cylinder type of engine according to claim 5, wherein the individual rings are of substantially uniform thickness and taper toward the axis thereof at an angle to the base in the range of 75°-85°.

* * * * *